US008678327B1

(12) United States Patent
McMiller et al.

(10) Patent No.: US 8,678,327 B1
(45) Date of Patent: Mar. 25, 2014

(54) LINER HOLDER FOR TRASH RECEPTACLE

(76) Inventors: David McMiller, Alpharetta, GA (US); Michael M. Potempa, Freeport, IL (US); Brian S. Potempa, Freeport, IL (US)

( * ) Notice: Subject to any disclaimer, the term of this patent is extended or adjusted under 35 U.S.C. 154(b) by 0 days.

(21) Appl. No.: 13/572,853

(22) Filed: Aug. 13, 2012

(51) Int. Cl.
*B65B 67/04* (2006.01)

(52) U.S. Cl.
USPC ..... 248/101; 248/100; 248/215; 248/316.6; 248/316.7; 24/30.5 R; 24/518

(58) Field of Classification Search
USPC ..... 248/95, 99, 100, 101, 96, 97, 215, 248/316.1, 316.5, 316.6, 546, 216.1, 316.7; 24/30.5 R, 30.5 S, 521, 518, 31 R
See application file for complete search history.

(56) References Cited

U.S. PATENT DOCUMENTS

| | | | | | |
|---|---|---|---|---|---|
| 706,522 | A * | 8/1902 | Bryant | 24/498 |
| 717,499 | A * | 12/1902 | Gouy | 132/133 |
| 720,919 | A * | 2/1903 | Hirsh | 24/327 |
| 769,336 | A * | 9/1904 | Cahn et al. | 24/499 |
| 1,243,108 | A * | 10/1917 | Richardson | 24/498 |
| 2,595,391 | A * | 5/1952 | Knowlton | 24/518 |
| 2,895,194 | A * | 7/1959 | Hanson | 24/327 |
| 3,861,771 | A * | 1/1975 | Cornell | 439/434 |
| 4,153,321 | A * | 5/1979 | Pombrol | 439/437 |
| 4,209,879 | A * | 7/1980 | Paajanen | 24/519 |
| 4,775,121 | A * | 10/1988 | Carty | 248/68.1 |
| 5,236,760 | A * | 8/1993 | Jinn | 428/100 |
| 5,860,529 | A * | 1/1999 | Smithson et al. | 206/554 |
| 6,516,500 | B2 * | 2/2003 | Ogino et al. | 24/504 |
| 6,557,716 | B1 * | 5/2003 | Chan | 220/9.4 |
| 6,609,641 | B2 * | 8/2003 | Sutton | 223/96 |
| 6,675,449 | B2 * | 1/2004 | Wales | 24/559 |
| 7,641,835 | B2 * | 1/2010 | Ramsey et al. | 264/260 |
| 7,694,838 | B2 * | 4/2010 | Yang et al. | 220/495.11 |
| 8,061,546 | B2 * | 11/2011 | Ramsey | 220/495.11 |
| 2004/0083580 | A1 * | 5/2004 | Gerson | 24/3.11 |
| 2004/0200938 | A1 * | 10/2004 | Forlivio | 248/213.2 |
| 2008/0272127 | A1 * | 11/2008 | Kovacevich et al. | 220/495.11 |
| 2010/0313390 | A1 * | 12/2010 | Lo | 24/521 |

* cited by examiner

*Primary Examiner* — Nkeisha Smith

(57) ABSTRACT

A trash bag securing device has a rotatable member and a stationary member. The stationary member is attached to the trash receptacle. The rotatable member has a first bag securing means which may include a bag containment area. The stationary member includes a second bag securing means which may include a point.

10 Claims, 9 Drawing Sheets

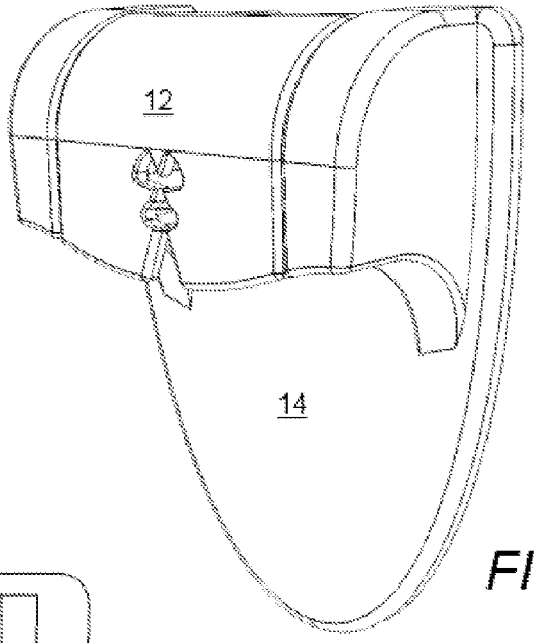
FIG. 5
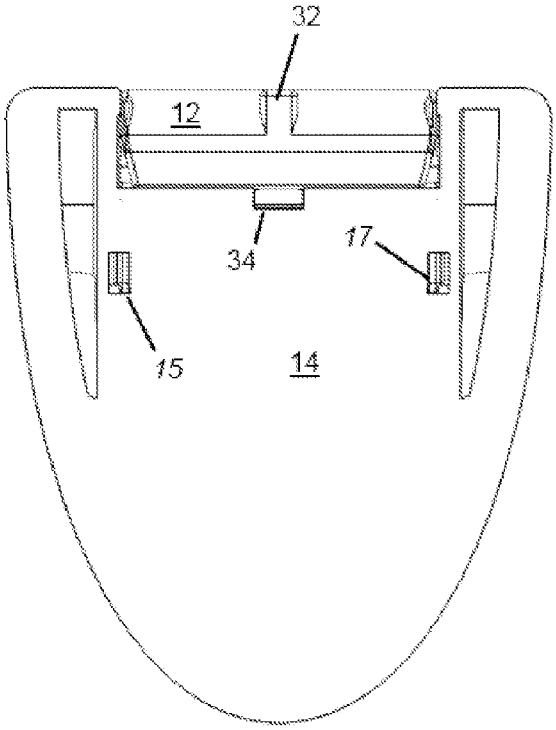
FIG. 6
FIG. 7
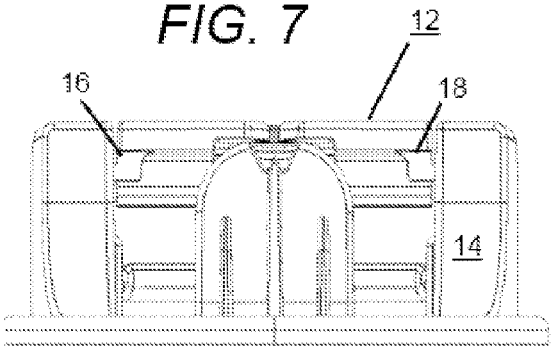

LINER HOLDER FOR TRASH RECEPTACLE

FIELD OF THE INVENTION

This invention relates to devices for attaching trash liners, also known as trash bags, to a trash receptacle.

BACKGROUND OF THE INVENTION

Trash receptacles are well known, as is the use of plastic trash bags within the trash receptacles. A trash bag is conventionally placed within the trash receptacle, and then affixed around the opening of the trash receptacle.

Trash bags are convenient in that they allow quick and easy removal of the contents of the trash receptacles. The problem with the trash bags is that they tend to become dislodged from their position on the trash receptacle as refuse is placed within the trash bag. The weight of the refuse may pull a portion of the trash bag from the trash receptacle, or may pull the entire trash bag from the trash receptacle.

Different devices have been employed in an attempt to stop the trash bag from being partially or completely dislodged from the opening of the trash receptacle. For example, a knot could be placed in the trash bag. U.S. Pat. No. 8,061,546 shows a trash receptacle provided with a plurality of openings around the exterior of the trash receptacle so that a portion of the trash bag might be inserted through the openings. Similarly, the trash receptacle shown in U.S. Pat. No. 7,694,838 is provided with a single large opening for insertion of a portion of the trash bag. And, in U.S. Pat. No. 7,641,835 another variation is shown where an opening is provided in the trash receptacle for insertion of a portion of the trash bag.

The devices, however, fail to either fully secure the bag or complicate the removal of the bag from the trash receptacle. Thus, an improved mechanism for securing a trash bag within a trash receptacle is highly desirable.

SUMMARY OF THE INVENTION

A trash bag securing device has a rotatable member and a stationary member. The stationary member is attachable to a trash receptacle. The stationary member is capable of receiving the rotatable member. The stationary member also includes a platform for securing the trash bag to the trash bag securing device. The platform has a generally W-shaped notch located in the center of the platform. The notch includes a reinforced point.

The trash bag securing device of also may have an upper support structure and a lower support structure. The upper support structure could include a first horizontal support beam. The upper support structure could further include a second horizontal support beam. A first leg and a second leg, could be attached to the first horizontal support beam and the second horizontal support beam respectively. A bridge could connect the first leg to the second leg.

The trash bag securing device may further include a horizontal support beam. The trash bag securing device may have a back wall where the platform is attached to the back wall by way of an anchor.

The rotatable member could include a front panel. A bag containment area could be present in the front panel. The bag containment area could have a clover-leaf shape. A channel in the front panel could assist in the placement of a portion of a trash bag into the bag containment area.

The stationary member might include a hinge rod such that the rotatable member is removably secured to the stationary member by a rod housing which attaches around the hinge rod.

The rotatable member may be provided with a stop so as to prohibit rotation of the rotatable member beyond a desired position.

The rod housing has a rod housing upper surface and a rod housing lower surface. The lower surface is at least partially in contact with the hinge rod when the rotatable member is attached to the stationary member. A guide post is positioned on the rod housing lower surface, the guide post at least partially contained within a guide slot on the hinge rod when the rotatable member is attached to the stationary member.

The rotatable member also includes a tab. The tab fits within a horizontal slot in the stationary member, the tab being at least partially contained within the horizontal slot when the rotatable member is attached to the stationary member.

In another aspect, a trash bag securing device has a rotatable member and a stationary member. The stationary member is attachable to a trash receptacle. The rotatable member has a first bag securing means and the stationary member has a second bag securing means.

The first bag securing means could have a bag containment area for securing a first portion of a trash bag. The second bag securing means could have a point for securing a second portion of the trash bag.

The rotatable member could have a front panel. The front panel of the rotatable member could be used to engage the point of the stationary member with the second portion of the trash bag.

The trash bag securing device of could include a platform. The point would be contained at least partially within the platform. A platform support means could be provided so as to stabilize the platform.

In another aspect of the invention, the stationary member includes a hinge rod and the rotatable member includes a rod housing. The rotatable member is releasably attached to the stationary member by placement of the rod housing at least partially around the hinge rod.

These and other features of the present invention will become readily apparent upon consideration of the following specification and drawings.

BRIEF DESCRIPTION OF THE DRAWINGS

FIG. 5 an isometric view of the trash bag securing device, with the rotatable member in the closed position.

FIG. 6 is a view of the rear of the trash bag securing device with the rotatable member in the closed position.

FIG. 7 is a bottom view of the trash bag securing device with the rotatable member in the closed position.

DESCRIPTION OF THE DRAWINGS

Figure 1:
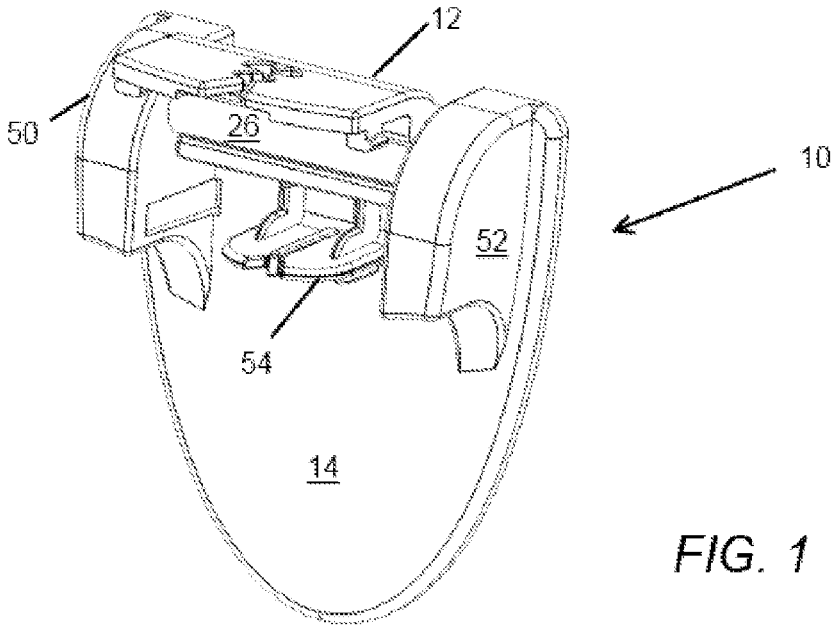
FIG. 1 shows an isometric view of a trash bag securing device.
Figure 2:
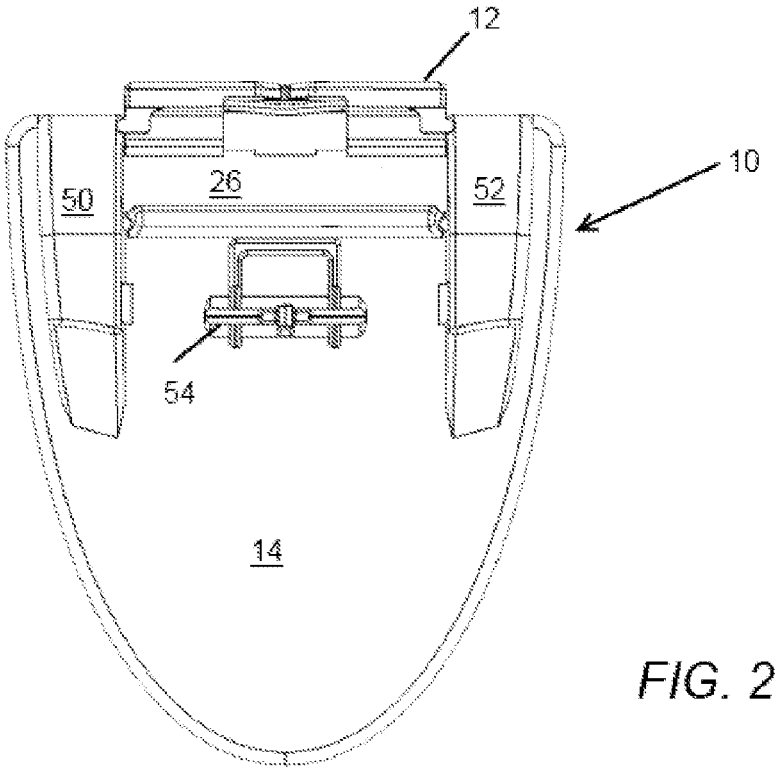
FIG. 2 shows a front view of the trash bag securing device.
Figure 3:
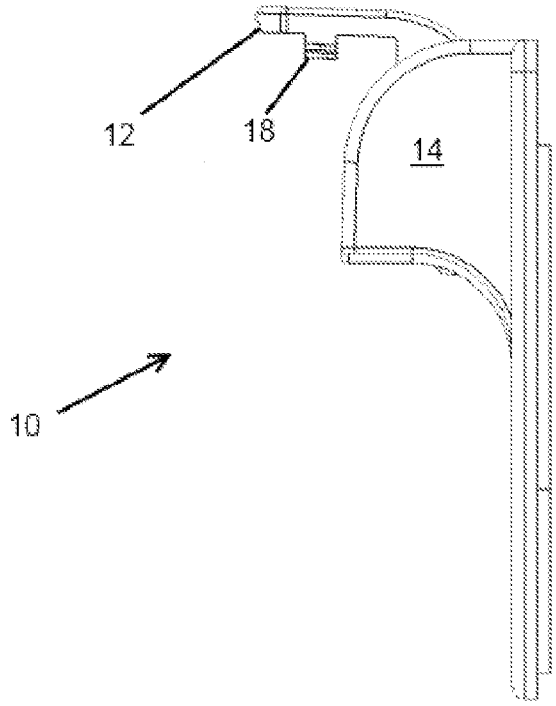
FIG. 3 shows the trash bag securing device from the side.
Figure 4:
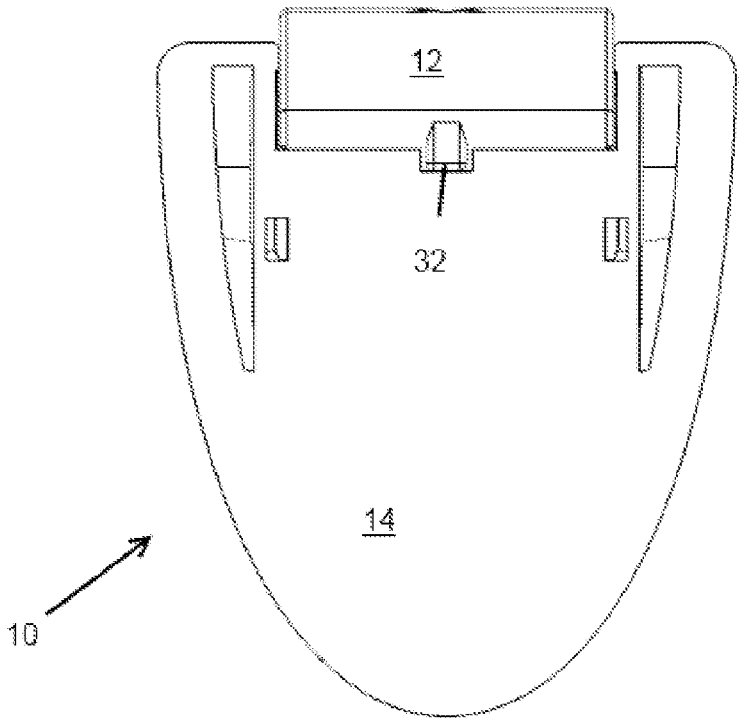
FIG. 4 shows the trash bag securing device from the rear.

FIG. 1 shows an isometric view of a trash bag securing device 10, while FIG. 2 shows a front view of the trash bag securing device 10. FIG. 3 shows the trash bag securing device 10 from the side. FIG. 4 shows the trash bag securing device 10 from the rear. In FIG. 1, FIG. 2, FIG. 3 and FIG. 4, the trash bag securing device is shown open, without a trash bag.

The trash bag securing device 10 is shown as open without a trash bag installed. The trash bag securing device includes a rotatable member 12. The rotatable member 12 sits within the stationary member 14.

FIG. 5 an isometric view of the trash bag securing device 10, this time with the rotatable member 12 in the closed position. FIG. 6 is a view of the rear of the trash bag securing device 10 with the rotatable member 12 in the closed position. FIG. 7 is a bottom view of the trash bag securing device 10 with the rotatable member 12 in the closed position.

Figure 8:
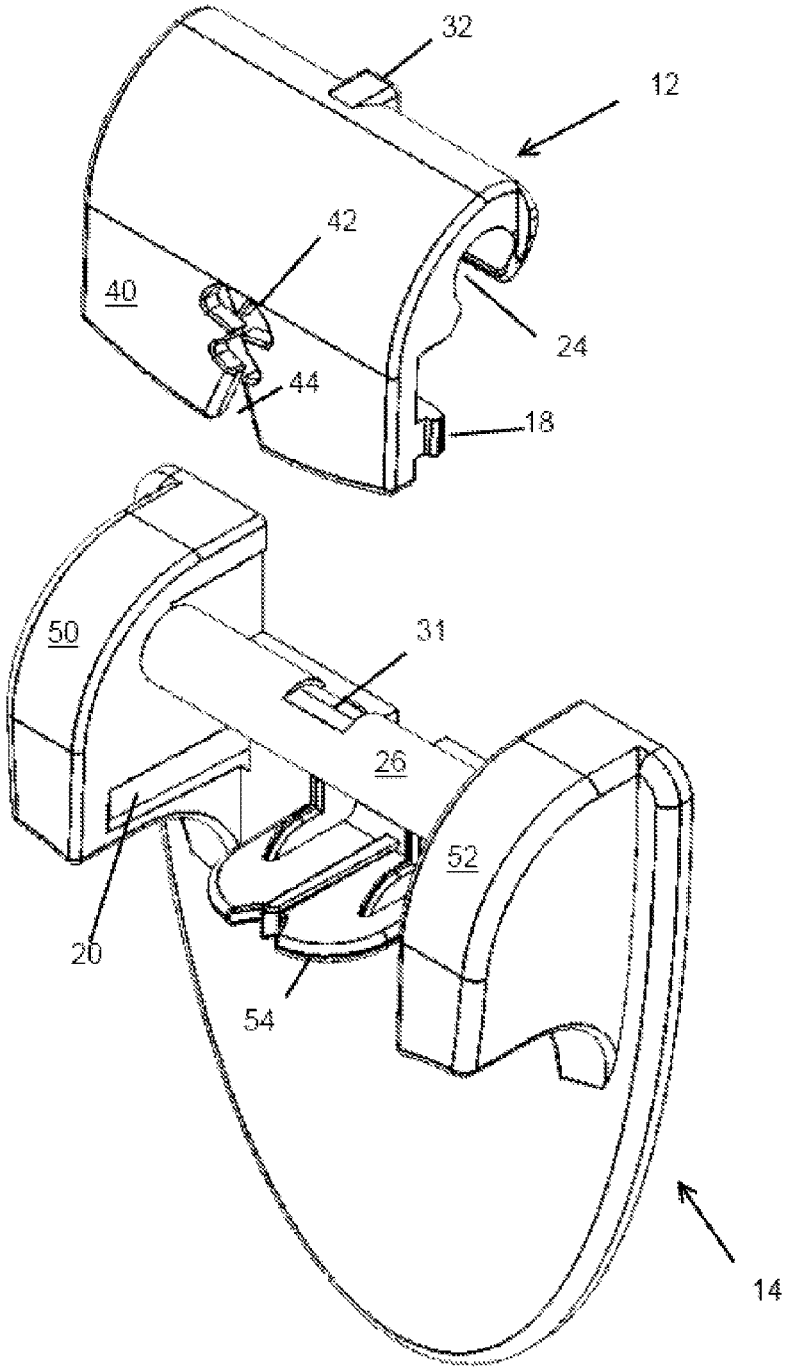
FIG. 8 shows an exploded view of the trash bag securing device.

FIG. 8 shows an exploded view of the trash bag securing device 10. The rotatable member 12 has been removed from the stationary member 14.

Figure 9:
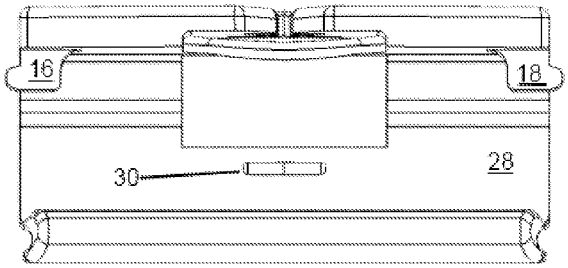
FIG. 9 shows a bottom view of the rotatable member of the trash bag securing device.
Figure 11:
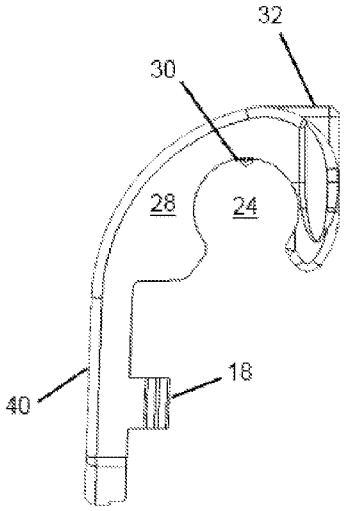
FIG. 11 shows a front view of the rotatable member of the trash bag securing device.
Figure 10:
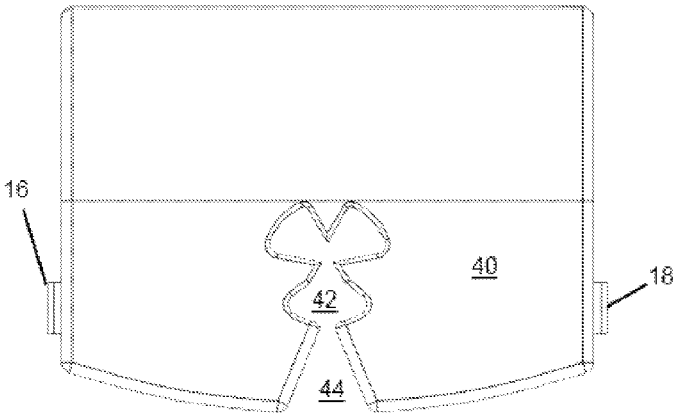
FIG. 10 shows a side view of the rotatable member of the trash bag securing device.

FIG. 9 shows a bottom view of the rotatable member 12. FIG. 10 shows a side view of the rotatable member 12. FIG. 11 shows a front view of the rotatable member 12.

The rotatable member 12 includes a pair of tabs 16, 18. The tabs 16, 18 assist in holding the rotatable member 12 in the closed position with relation to stationary member 14. When the rotatable member 12 is closed, the tabs 16, 18 reside within a pair of horizontal slots 20, 22.

The semicircular orifice 24 within the rotatable member 12 connects to the hinge rod 26 of the stationary member 14. The semicircular orifice 24 is contained within a plastic rod housing 28. Thus, as the rotatable member 12 is pressed onto the hinge rod 26, the rod housing 28 spreads, allowing the semicircular orifice 24 to expand, thereby allowing the rod housing 28 to attach to the hinge rod 26. When the rotatable member 12 in secured to the stationary member 14, the plastic orifice housing 28 returns to its original shape, thereby capturing the hinge rod 26.

If the rotatable member 12 is removed from the stationary housing 14, the plastic orifice housing 28 again will be spread apart as the rotatable member 12 is removed, thereby releasing the hinge rod 26.

A guide post 30 sits on the lower surface of the plastic rod housing 28. The guide post 30 of the rotatable member 12 fits within the guide slot 31 of the stationary member 14. The guide post 30 and the tabs 16, 18 assist in maintaining the smooth rotation of the rotatable member 12 when affixed to the stationary member 14.

A stop 32 is affixed to the exterior of the rotatable member 12. The stop 32 interacts with the stop slot 34 of the stationary member 14. The stop 32 along with the stop slot 34 of the stationary member 14 prohibits rotational movement of the rotatable member 12 beyond a desired amount. In most cases, the rotatable member 12 is rotatable over a range of motion of about 180 degrees.

The rotatable member 12 also includes a front panel 40. The front panel 40 contains a bag containment area 42. The bag containment area 42 contains a portion of a trash bag. As shown, the bag containment area 42 could be configured in a generally clover-leaf shape. Any suitable geometric configuration could be used. The front panel also includes a channel 44. Channel 44 is used to guide a portion of a trash bag into the bag containment area 42.

Figure 12:
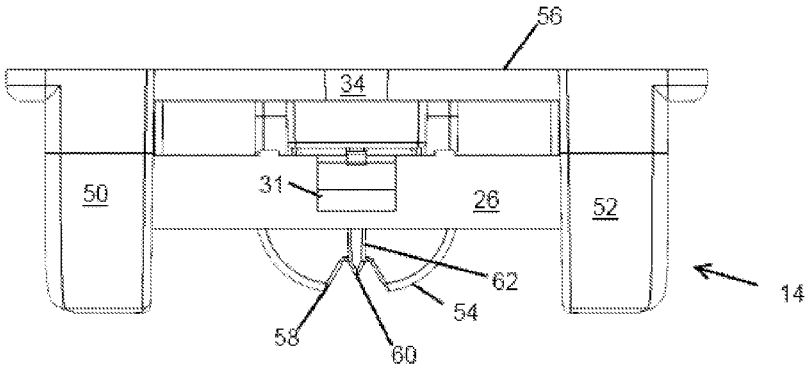
FIG. 12 shows a top view of the stationary member.
Figure 13:
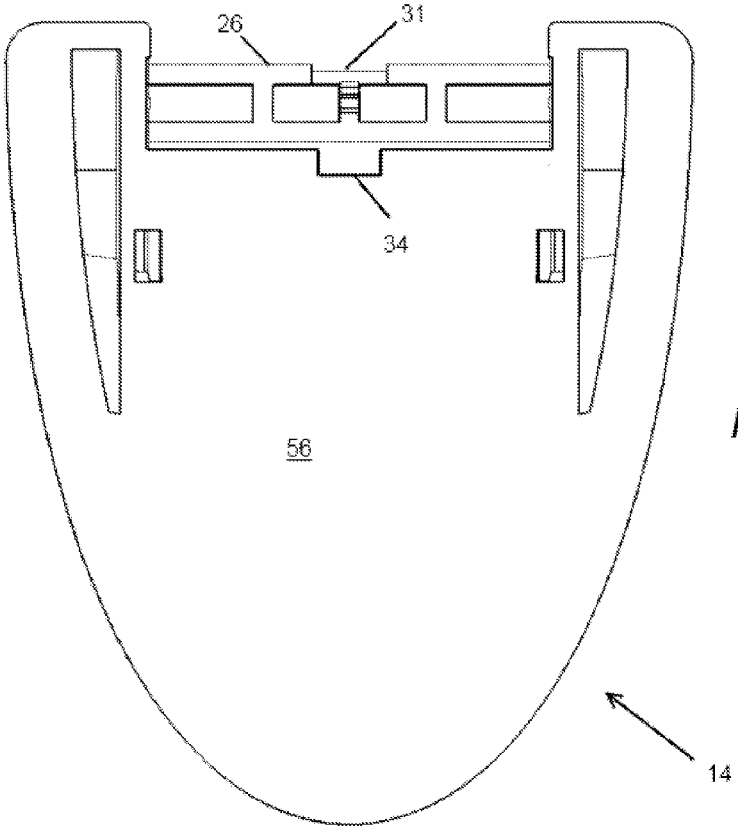
FIG. 13 shows a back view of the stationary member.

FIG. 12 shows a top view of the stationary member 14, while FIG. 13 shows a back view of the stationary member 14. As stated previously, when the rotatable member 12 is affixed to the stationary member 14, the plastic orifice housing 28 contains the hinge bar 26, allowing the rotatable member 12 to rotate. The guide post 30 resides within the guide slot 31. The stop slot 34 interacts with the stop 32 to prohibit excessive rotational movement of the rotatable member 12.

The hinge bar 26 is affixed to a first shoulder 50 and a second shoulder 52. The first shoulder 50 and the second shoulder 52 are on opposite sides of the stationary member 14. The first shoulder 50 and the second shoulder 52 are positioned generally vertically, while the hinge bar 26 is positioned generally horizontally between the first shoulder 50 and the second shoulder 52.

A platform assembly 53 extends from the back wall 56 of the stationary member 14. The platform assembly 53 includes a platform 54. The platform 54 includes a notch 58. The notch 58 in the shown embodiment is generally W-shaped. Any suitable notch arrange may be workable within the system as shown in the drawings.

Extending into the center of the notch 58 is a point 60. The point 60 has been reinforced by a reinforcement portion 62. The reinforcement portion 62 is, in this embodiment, an extra-heavy area of plastic.

Figure 14:
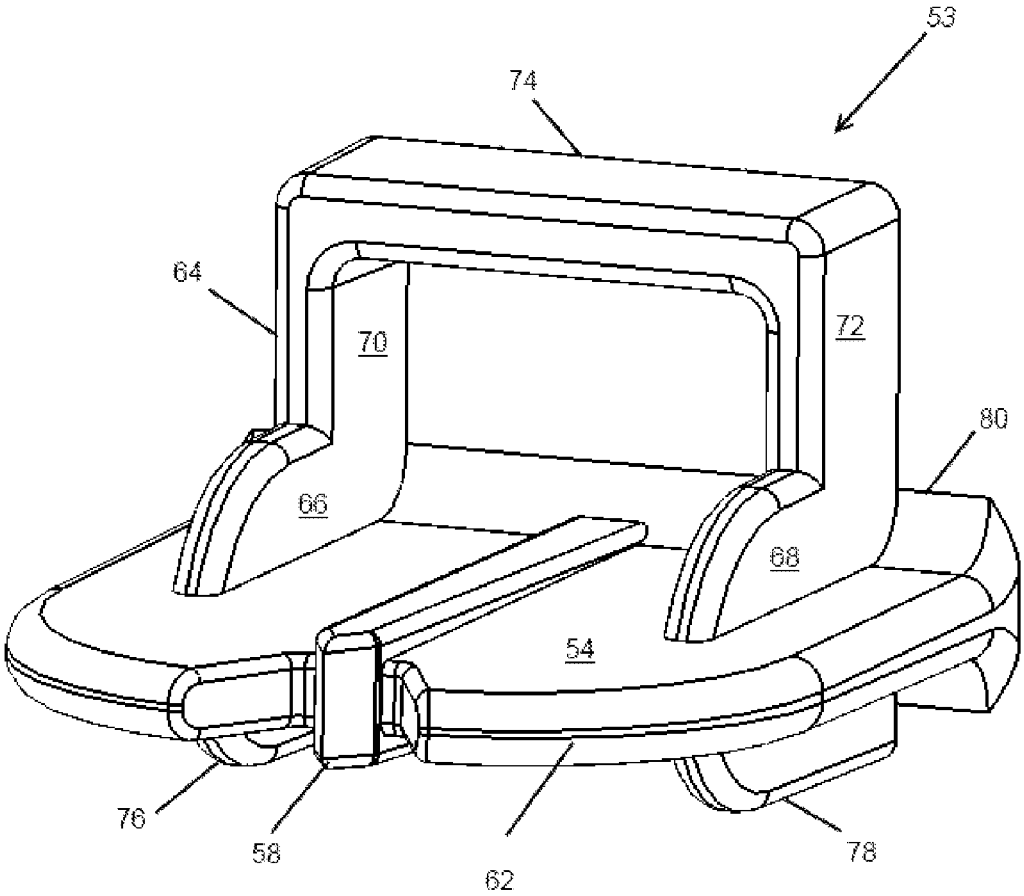
FIG. 14 shows a closer view of the platform assembly

FIG. 14 shows a closer view of the platform assembly 53. Platform 54 includes a point 58. The point 58 is somewhat larger than platform 54 in that it extends both above and below the platform 54. This configuration makes the point 58 somewhat more resistant to movement than the platform 54, and therefore the platform 54 is less flexible than the platform 54. The forward edge 62 of the platform 54 is tapered and somewhat rounded.

The platform assembly 53 includes an upper support structure 64. As can be seen, the upper support structure includes a pair of horizontal reinforcement beams 66, 68 extending horizontally across the top of the platform 54. The horizontal reinforcement beams 66, 68 are attached to legs 70, 72. The legs 70, 72 are affixed to the back wall 56 of the stationary member 14. A bridge 74 connects the legs 70, 72. The bridge 74 is also affixed to the back wall 56 of the stationary member 14.

Beneath the platform 54 are a pair of horizontal support beams 76, 78, forming a lower support structure. The platform 54 is further affixed to the back wall 56 by an anchor 80. The anchor 80 is generally flared, with a larger portion affixed to the ball wall 56 that gradually narrows until the anchor 80 becomes approximately the same width as that of the platform 54.

In use, the trash bag securing device 10 operates as follows. The rotatable member 12 is affixed to the stationary member 14. The rotatable member 12 is in the open position, as shown in FIG. 1. A portion of the trash bag is inserted into the bag containment area 42. The channel 44 assists in guiding the trash bag into the bag containment area. Additionally, a portion of the bag may extend into the channel 44. When a portion of the bag is inserted into the bag containment area 42, the bag gathers in and around the bag containment area 42.

The rotatable member 12 is then rotated into the closed position, as shown in FIG. 5. The tabs 18 lock into the slots 20. The front panel 40 pushes the bag into contact with the front portion of the platform 54 of the platform assembly 53. The notch 58 receives a portion the bag. The leading edge of the platform 54 is pressed into the bag by the operation of the front panel 40. The point 60 is pressed into the bag.

When the bag is to be removed, a person pulls on the front panel 40, and the tabs 18 are removed from the slots 20. The rotatable member 12 can be rotated into the full open position, and the bag easily removed from the trash receptacle.

The upper support structure 64 helps stabilize the movement of the platform 54 in case the bag is pulled upward. The more elaborate design of the upper support structure 64 is necessary because a bag may be pulled from the trash bag securing device 10 without properly unlocking the rotatable member 12 from the stationary member 14.

The trash bag securing device 10 can be affixed to a trash receptacle by way of a double-sided adhesive strip. The double sided adhesive strip can be placed on the rear of the back wall 56, and then affixed to a side of the trash receptacle.

Alternatively, a trash receptacle could be designed for use with the trash bag securing device 10.

Figure 15:
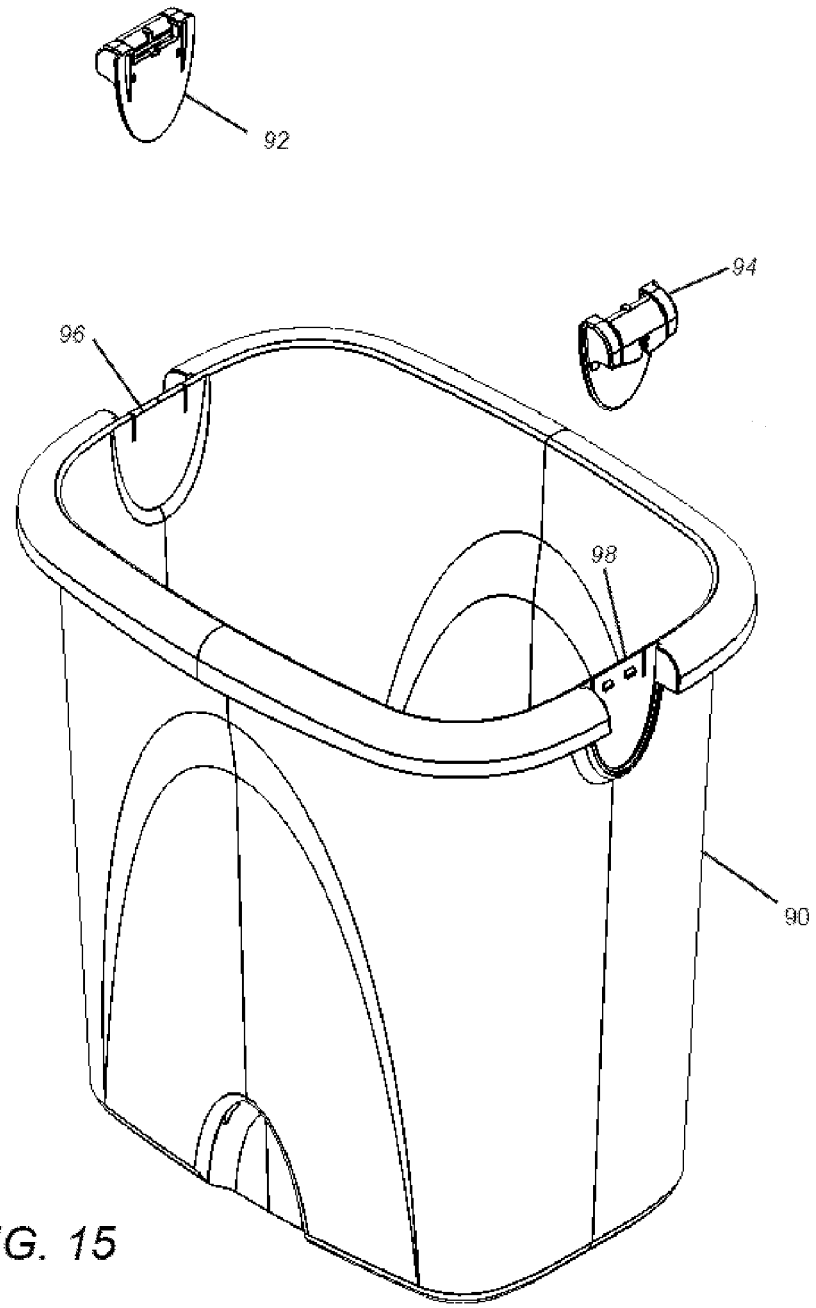
FIG. 15 shows a trash receptacle.
Figure 16:
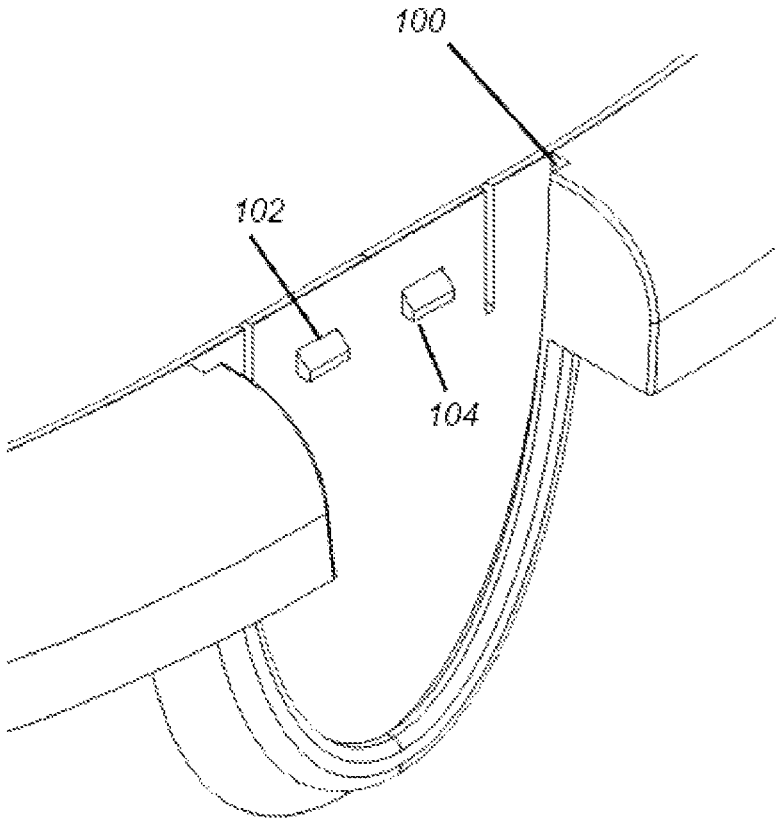
FIG. 16 shows an area of the trash receptacle in greater detail.

FIG. 15 shows a trash receptacle 90. The trash receptacle 90 includes receiving areas 96, 98 for the placements of the trash bag securing device 92, 94. FIG. 16 shows one of the receiving areas 96, 98 in greater detail.

The receiving area includes a slot 100 for receiving the trash bag securing device 10. Additionally, locking tabs 102, 104 are located with the receiving area. The locking tabs 102, 104 insert into the openings 15, 17 (shown in FIG. 6) of the stationary member 14 of the trash bag securing device 10.

Trash receptacle, as used herein, refers to any size of shape of trash receptacle, and includes objects such as shredders, recycling bins, or other devices where there is an enclosed compartment for receiving refuse.

It should be noted that reference to the prior art herein is not to be taken as an acknowledgement that such prior art constitutes common general knowledge in the art.

The terms "comprising" or "comprises" as used throughout the specification and claims are taken to specify the presence of the stated features, integers and components referred to but not preclude the presence or addition of one or more other feature/s, integer/s, component/s or group thereof.

While the above has been given by way of illustrative embodiments, all such variations and modification thereto as would be apparent to persons skilled in the art are deemed to fall within the broad scope and ambit of the invention as herein defined in the appended claims.

The invention claimed is:

1. A trash bag securing device comprising: a rotatable member; and a stationary member attachable to a trash receptacle, the stationary member capable of receiving the rotatable member, and a platform for securing the trash bag to the trash bag securing device, the platform having a generally W-shaped notch located in the center of the platform, the generally W-shaped notch including a point, the point being reinforced and the platform further having an upper support structure and a lower support structure, the upper support structure having a first horizontal support beam and a second horizontal support beam, a first leg and a second leg, the second leg connecting the second horizontal support beam to a bridge.

2. The trash bag securing device of claim 1 where the lower support structure includes a horizontal support beam.

3. The trash bag securing device of claim 2 where the stationary member includes a back wall, and the platform is attached to the back wall by way of an anchor.

4. The trash bag securing device of claim 3 where the rotatable member includes a front panel, and the front panel includes a bag containment area.

5. The trash bag securing device of claim 4 where the bag containment area has a clover-leaf shape.

6. The trash bag securing device of claim 5 further comprising a channel for assisting the placement of a portion of a trash bag into the bag containment area.

7. The trash bag securing device of claim 6 where the stationary member includes a hinge rod, and the rotatable member is removably secured to the stationary member by a rod housing which attaches around the hinge rod.

8. The trash bag securing device of claim 7 where the rotatable member has a stop so as to prohibit rotation of the rotatable member beyond a desired position.

9. The trash bag securing device of claim 8 where the rod housing has a rod housing upper surface and a rod housing lower surface, the lower surface being at least partially in contact with the hinge rod when the rotatable member is attached to the stationary member, further comprising a guide post on the rod housing lower surface, the guide post at least partially contained within a guide slot on the hinge rod when the rotatable member is attached to the stationary member.

10. The trash bag securing device of claim 9 further comprising a tab on the rotatable member and a horizontal slot in the stationary member, the tab being at least partially contained within the horizontal slot when the rotatable member is attached to the stationary member.

* * * * *